US010400444B1

(12) United States Patent
Graboski et al.

(10) Patent No.: US 10,400,444 B1
(45) Date of Patent: Sep. 3, 2019

(54) HYBRID SEALED ATTIC INSULATION AND VENTILATION SYSTEM

(71) Applicants: Timothy Graboski, Pompano Beach, FL (US); David Faulkner, Lakewood Ranch, FL (US); Mike Boulding, Davenport, FL (US)

(72) Inventors: Timothy Graboski, Pompano Beach, FL (US); David Faulkner, Lakewood Ranch, FL (US); Mike Boulding, Davenport, FL (US)

( * ) Notice: Subject to any disclaimer, the term of this patent is extended or adjusted under 35 U.S.C. 154(b) by 0 days.

(21) Appl. No.: 15/659,315

(22) Filed: Jul. 25, 2017

Related U.S. Application Data

(63) Continuation of application No. 14/066,822, filed on Oct. 30, 2013.

(Continued)

(51) Int. Cl.
*E04B 1/70* (2006.01)
*E04B 1/76* (2006.01)

(Continued)

(52) U.S. Cl.
CPC ..... *E04B 1/7675* (2013.01); *E04B 1/70* (2013.01); *E04B 1/7069* (2013.01); *E04B 1/80* (2013.01); *E04B 7/00* (2013.01); *E04D 13/1637* (2013.01); *E04B 7/18* (2013.01); *E04D 13/16* (2013.01); *E04D 13/1606* (2013.01);

(Continued)

(58) Field of Classification Search
CPC . E04B 1/7675; E04B 1/80; E04B 1/70; E04B 1/7069; E04B 7/00; E04B 7/18; Y10T 428/24628; E04D 13/16; E04D 13/1606; E04D 13/1637; E04D 13/17;

(Continued)

(56) References Cited

U.S. PATENT DOCUMENTS 2,318,820 A 5/1943 Voigt et al.
2,853,222 A 9/1958 Gallagher (Continued)

FOREIGN PATENT DOCUMENTS

JP 2010037826 2/2010

OTHER PUBLICATIONS

Pencille, Douglas; "Proper Attic Ventilation"; (Mar. 5, 2001) <http://www.dspinspections.com/atticventing.htm>.*

*Primary Examiner* — David Sample
*Assistant Examiner* — Donald M Flores, Jr.
(74) *Attorney, Agent, or Firm* — Gable Gotwals

(57) ABSTRACT

A sealed attic insulating and roof ventilating system includes a plenum formed in part by a barrier material attached to adjacent pairs of rafters and having a radiant or reflective upper surface and a corrugated lower surface to which an insulation material may be secured. This arrangement creates an uninterrupted air chamber or ventilation plenum between the barrier material, the adjacent rafters, and the roof decking through which exterior air can circulate unimpeded from the lower vents to the upper vents of the roof. The circulation through the ventilation plenum prevents moisture from accumulating or condensing under the roof decking and warping the roof decking, which ultimately leads to deterioration of the roof decking and failure of the roof covering, and eliminates ice damming on the top surface of the roof covering.

11 Claims, 1 Drawing Sheet

Related U.S. Application Data

(60) Provisional application No. 61/752,129, filed on Jan. 14, 2013.

(51) Int. Cl.

| | |
|---|---|
| ***E04B 1/80*** | (2006.01) |
| ***E04B 7/00*** | (2006.01) |
| ***E04B 7/18*** | (2006.01) |
| ***E04D 13/16*** | (2006.01) |
| ***E04D 13/17*** | (2006.01) |
| ***F24F 13/20*** | (2006.01) |
| ***F24F 7/02*** | (2006.01) |
| ***F24F 7/04*** | (2006.01) |

(52) U.S. Cl.
CPC ..... *E04D 13/17* (2013.01); *E04D 13/172* (2013.01); *F24F 7/02* (2013.01); *F24F 7/04* (2013.01); *F24F 13/20* (2013.01); *Y10T 428/24628* (2015.01)

(58) Field of Classification Search
CPC ... E04D 13/172; F24F 7/02; F24F 7/04; F24F 13/20
USPC .... 52/302.1, 404, 741.4, 745.05, 746.1, 750
See application file for complete search history.

(56) References Cited

U.S. PATENT DOCUMENTS 3,404,748 A * 10/1968 Bjorksten ..... B31F 1/2886 428/105
4,228,729 A * 10/1980 Messick ..... E04D 13/17 454/238
4,290,247 A 9/1981 Alderman
4,401,706 A 8/1983 Sovilla
4,635,419 A * 1/1987 Forrest ..... E04D 13/172 454/185
4,635,423 A * 1/1987 Ward ..... E04B 1/642 156/71
4,934,338 A 6/1990 Hollick et al.
5,205,473 A 4/1993 Coffin, Sr.
5,560,157 A * 10/1996 Rotter ..... E04D 13/152 52/95
5,992,112 A 11/1999 Josey
6,780,099 B1 * 8/2004 Harper ..... E04D 3/352 454/185
6,797,356 B2 9/2004 Zupon et al.
7,094,145 B2 8/2006 Rye et al.
7,143,551 B2 * 12/2006 Corwin ..... E04B 1/26 52/95
7,302,776 B2 12/2007 Duncan et al.
D581,511 S 11/2008 Rosten et al.
7,856,764 B2 12/2010 Kortuem et al.
7,861,467 B2 1/2011 Rosten et al.
8,347,562 B2 1/2013 Morris et al.
2004/0134137 A1 * 7/2004 Geer ..... E04D 13/158 52/95
2006/0117686 A1 * 6/2006 Mankell ..... E04D 13/1625 52/302.1
2008/0163565 A1 * 7/2008 Toas ..... E04D 13/172 52/95
2008/0202041 A1 8/2008 Dillon
2009/0044797 A1 2/2009 Klement
2011/0168165 A1 * 7/2011 Puriri ..... E04D 13/17 126/621
2013/0074428 A1 3/2013 Allen et al.
2013/0247489 A1 9/2013 Janesky
2014/0141199 A1 * 5/2014 Leonard ..... B32B 27/08 428/138

* cited by examiner

HYBRID SEALED ATTIC INSULATION AND VENTILATION SYSTEM

CROSS-REFERENCE TO PENDING APPLICATIONS

This application is a continuation application of U.S. patent application Ser. No. 14/066,822, filed Oct. 30, 2013, which claimed the benefit of U.S. Provisional Patent Application No. 61/752,129 filed, Jan. 14, 2013.

BACKGROUND

The present disclosure relates generally to an improved attic and under-roof deck insulation system. More particularly, the present invention relates to a radiant barrier material for use in an attic insulation system that provides the benefits of both a conventional ventilated attic system and a sealed attic system.

To date, there are no effective means of preventing a spray polyurethane insulation or its equivalent from coming into contact with the underside of the roof decking or sheathing. There are ribbed baffle vents or panels made of vacuum molded polyvinyl chloride film which are installed between the rafters and the roof sheathing and provide a passage for air to flow from the building to the roof vent (see e.g. U.S. Pat. No. 7,861,467 B2; see also e.g. U.S. Pat. No. D581,511 S). Other types of ribbed baffles are placed between the rafters on the underside of the sheathing (see e.g. U.S. Pat. No. 7,856,764 B2; see also e.g. U.S. Pat. No. 7,094,145 B2).

None of the prior art panels creates an uninterrupted plenum or air barrier below the sheathing which spans the height of the rafters (thereby creating an air barrier), nor do they create a radiant barrier between the sheathing and panel. Additionally, none of the panels is water-resistant or fire-rated (retardant) nor intended to serve as a lath material for a spray polyurethane insulation or its equivalent. Last, the panels do not provide a monolithic assembly nor do they reinforce building envelope.

SUMMARY

An attic insulation and under roof decking ventilation system includes a plenum located below the roof decking, between adjacent roof rafters connected to the roof decking, and above a barrier material connected to the adjacent roof rafters. The plenum extends from the soffit vents to the roof vents, which permits exterior air to circulate under the roof decking unimpeded between the vents but prevents the exterior air from entering the interior space of the building structure located below the plenum.

A method for protecting a roof system from weather elements includes securing a barrier material to adjacent roof rafters that support the roof decking, thereby forming a plenum bordered by the roof decking, the adjacent roof rafters, and the upper surface of the barrier material. The method also includes circulating exterior air from a lower intake vent through the plenum and exhausting the exterior air through an upper vent in the roof decking.

ELEMENTS AND NUMBERING USED IN THE DRAWINGS AND DETAILED DESCRIPTION

Figures 1, 2:
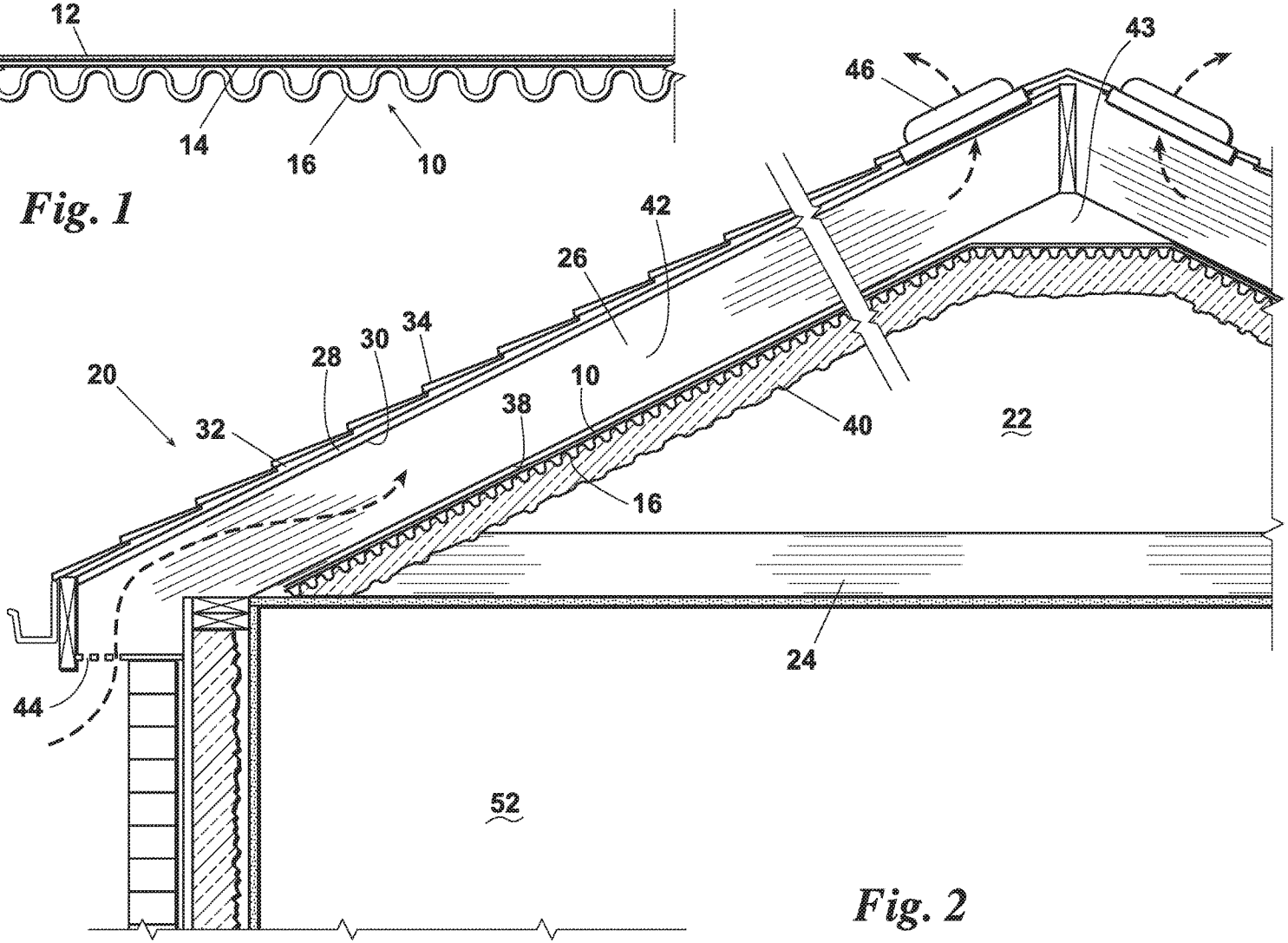
FIG. 1 is a cross-section view of an embodiment of a barrier material made according to this disclosure. The barrier material includes an upper, radiant barrier (reflective surface) layer and a lower, corrugated surface layer.
FIG. 2 is a view of the barrier material of FIG. 1 when installed as part of an attic insulation and under roof decking ventilation system. The barrier material may be installed in other applications in which an air space or plenum is desired between an external structure and insulating material designed to prevent heat transfer between an interior insulated space and the structure.

10 Barrier material
12 Upper layer or surface
14 Middle layer
16 Lower layer or surface
20 Hybrid sealed attic insulation and ventilation system
22 Attic space
24 Ceiling/floor joists
26 Roof rafters or truss top chord
28 Roof decking or sheathing
30 Bottom or inner side of 28
32 Roofing felt or underlayment
34 Weather-proof covering or roof system
38 Bottom side of 26
40 Insulating material
42 Air Chamber (ventilation plenum)
43 Exhaust plenum
44 Lower vents or intake ventilators
46 Upper vents or exhaust ventilators
52 Interior conditioned space

DETAILED DESCRIPTION

Referring to FIG. 1, a preferred embodiment of a barrier material 10 made according to this disclosure is comprised of an upper, radiant barrier (reflective surface) layer 12 and a lower, corrugated surface layer 16. Preferably, the barrier material receives a Class 1/Class A rating as specified under ASTM E84.

Upper layer 12 is a barrier surface and preferably one that meets the requirements of ASTM C1313. In a preferred embodiment, the layer 12 is a metalized film or an aluminum sheet with an emissivity rating of 0.1 or less. Upper layer 12 is laminated to one side of middle layer 14 using a high heat-resistant adhesive. Preferably, the high heat-resistant adhesive is rated up to 325° F. Adhesives having a higher heat-resistant rating may be used.

Middle layer 14 is preferably fire retardant and water resistant. In a preferred embodiment, middle layer 14 is a kraft linerboard. The linerboard may have a weight of at least 33 lbs/1000 sq-ft.

Lower layer 16 is a reinforced surface and is preferably a corrugated medium. The corrugated medium may have a weight of not less than 23 lbs/1000 sq-ft. Lower layer 16 is laminated to the other side of the middle layer 12 using a water-resistant adhesive.

Referring now to FIG. 2, barrier material 10 can be a part of a system 20 used to insulate an attic space 22 typically located between the ceiling/floor joists 24 and the roof rafters (or truss top chords) 26. The roof rafters 26 support the roof decking 28 which, in turn, is typically overlaid with some type of weather-proof covering 34, such as composite shingles, tiles, metal, or the like. A roofing felt or underlayment 32 may also be located between covering 34 and the decking 28.

Barrier material 10 is attached to the bottom side 38 of the rafters 26 (or between rafters) so that the upper, radiant barrier layer 12 is facing, but not touching, the inner side 30 of the roof decking 28 and the lower, corrugated surface layer 16 is facing away and toward the ceiling/floor joists 24 (i.e. attic space 22). Preferably, radiant barrier material 10 is sized to span the center-to-center distance of adjacent rafters 26.

This arrangement provides an air chamber or plenum 42 between the decking 28 and the upper, radiant barrier layer 12. In a preferred embodiment, plenum 42 spans the distance between adjacent pairs of rafters 26, with the distance between the upper, radiant barrier layer 12 and the inner side of the roof decking 28 being the height of board used for the rafters 26 (e.g. 6 inches). An insulating material 40, such as but not limited to fiberglass insulation, spray polyurethane insulation or the like, may then be applied to the lower corrugated surface layer 16.

The installed barrier material 10 creates an uninterrupted pathway or plenum 42 located between the upper, radiant barrier layer 12, rafters 26, and roof decking 28 for air to circulate unimpeded from the lower (soffit or eave) vents 44 upward to the upper (roof or exhaust) vents 46. The upper vents 46 may be any type of roof vent commonly used, including but not limited to ridge vents, wind driven turbines, solar powered ventilators and electrically driven fan vents. The barrier material 10 can also be installed to create an exhaust plenum 43 toward the ridge portion of the roof.

The circulation of air through the plenum 42 allows moisture to evacuate from under the roof decking 28 and mitigates warping of the decking 28, deterioration of the decking 28, and pre-failure of the roof covering 34. This air circulation also eliminates ice damming on the top surface of the roof covering 34. Ice damming can also lead to roof damage as well as water infiltration to the roof and building structure.

The barrier material 10 and insulation material 40 can extend over the entire surface area defined by adjacent rafters 26 or a portion of that surface area. Once in place, the attic space 22 may be climate-controlled to make it more suitable for habitation or storage.

The barrier material 10 may be installed as a part of other systems in which an airspace or plenum 42 is desired between an external structure and the insulating material to prevent moisture accumulation as well as heat transfer between an interior insulated space and the structure.

The embodiments described above are not all possible embodiments of the invention. Therefore, the scope of the invention is defined by the following claims. Those claims cover elements which may not be specifically listed in the claims but represent trivial differences from, or are equivalent to, the specific elements listed in the claims.

What is claimed:

1. An attic insulation and under roof decking ventilation system comprising:

a ventilation plenum located below a roof decking and between adjacent roof rafters connected to the roof decking and extending an entire distance between a soffit vent at one end and a roof vent at another end;

the ventilation plenum including a barrier material connected to the adjacent roof rafters and forming a bottom of the ventilation plenum that also extends the entire distance between the soffit and roof vents, an underside of the roof decking forming a top of the ventilation plenum, the barrier material having a corrugated outermost lower face surface facing downward toward an interior attic space located below the ventilation plenum;

the ventilation plenum configured to permit exterior air entering the soffit vent to circulate unimpeded through the ventilation plenum between the soffit vent and the roof vent but preventing the circulating exterior air from entering the interior attic space-located below the ventilation plenum.

2. A system according to claim 1, wherein a height of the ventilation plenum is equal to a height of the adjacent roof rafters.

3. A system according to claim 1, the barrier material including a reflective radiant barrier outermost upper face surface, the reflective radiant barrier outermost face surface facing upward toward the underside of the roof decking.

4. A system according to claim 1, the barrier material including spray insulating foam located on the corrugated outermost lower face surface of the barrier material.

5. A system according to claim 1 further comprising the ventilation plenum continuing to extend, and be in fluid communication with, the roof vent and another soffit vent located opposite the soffit vent.

6. A system according to claim 1, the system having no heat transfer to the interior attic space from the ventilation plenum.

7. An attic insulation and under roof decking ventilation system comprising:

a ventilation plenum located below a roof decking and between adjacent roof rafters connected to the roof decking and extending an entire distance between a soffit vent at one end and a soffit vent at another end;

the ventilation plenum including a barrier material connected to the adjacent roof rafters forming a bottom of the ventilation plenum that also extends the entire distance between the soffit vents, an underside of the roof decking forming a top of the ventilation plenum, the barrier material having a corrugated outermost lower face surface facing an interior attic space located below the ventilation plenum;

the ventilation plenum configured to permit exterior air entering the soffit vents to circulate unimpeded through the ventilation plenum between the soffit vents and a roof vent located between the soffit vents but preventing the circulating exterior air from entering the attic space located below the ventilation plenum.

8. A system according to claim 7, wherein a height of the ventilation plenum is no greater than a height of the adjacent roof rafters.

9. A system according to claim 7, the barrier material including a reflective radiant barrier outermost upper face surface facing the underside of the roof decking.

10. A system according to claim 7, wherein spray insulating foam is located on the corrugated outermost face surface.

11. An attic insulation and under roof decking ventilation system comprising:

a ventilation plenum located below a roof decking and between adjacent roof rafters connected to the roof decking, the ventilation plenum having a height no greater than a height of the adjacent roof rafters and extending an entire distance between a soffit vent at one end and a soffit vent at another end;

the ventilation plenum including a barrier material forming a bottom of the ventilation plenum that also extends the entire distance between the soffit vents, the barrier material including a corrugated outermost lower face surface facing an interior attic space located below the ventilation plenum and a radiant barrier outermost upper face surface facing the underside of the roof decking, an underside of the roof decking forming a top of the ventilation plenum; and the ventilation plenum configured to permit exterior air entering the soffit vents to circulate unimpeded through the ventilation plenum between the soffit vents and a roof vent but preventing the circulating exterior air from entering the interior attic space located below the ventilation plenum.

* * * * *